United States Patent [19]

Speil

[11] Patent Number: 4,729,350

[45] Date of Patent: Mar. 8, 1988

[54] HYDRAULIC VALVE CLEARANCE COMPENSATION APPARATUS FOR INTERNAL COMBUSTION ENGINES

[75] Inventor: Walter Speil, Ingolstadt, Fed. Rep. of Germany

[73] Assignee: Motomak Motorenbau, Maschinen-und Werkzeugfabrik, Konstruktionen GmbH, Fed. Rep. of Germany

[21] Appl. No.: 31,233

[22] Filed: Mar. 26, 1987

[30] Foreign Application Priority Data

Apr. 26, 1986 [DE] Fed. Rep. of Germany ..... 3614258

[51] Int. Cl.[4] ..... F01L 1/24

[52] U.S. Cl. ..... 123/90.55; 123/90.46

[58] Field of Search ..... 123/90.39, 90.46, 90.45, 123/90.55, 90.36, 90.57, 90.58

[56] References Cited

U.S. PATENT DOCUMENTS

| | | | |
|---|---|---|---|
| 2,036,936 | 4/1936 | Halford | 123/90.46 |
| 3,179,094 | 4/1965 | Ribeton | 123/90.55 |
| 4,502,428 | 3/1985 | Paar | 123/90.46 |
| 4,523,551 | 6/1985 | Arai et al. | 123/90.46 |
| 4,570,582 | 2/1986 | Speil | 123/90.55 |
| 4,624,224 | 11/1986 | Kodama et al. | 123/90.46 |
| 4,644,914 | 2/1987 | Morita et al. | 123/90.55 |

*Primary Examiner*—Ira S. Lazarus

*Attorney, Agent, or Firm*—Bierman and Muserlian

[57] ABSTRACT

A hydraulic valve clearance compensation apparatus for internal combustion engines comprising a hydraulic compensation element accommodated in a bore of a rocker arm or actuating element which bore extends in prolongation of the stem of a motor valve and having a piston element guided for longitudinal displacement and provided with a crowned projection at its end facing the valve stem wherein a guide shoe is arranged between the crowned projection and the flat end face of the valve stem which, on the one hand, includes a spherical indentation engaged by the crowned projection of the piston element and, on the other hand, has a flat surface supported by the end face of the valve stem wherein the guide shoe is securely mounted to the valve stem, characterized in that a cage element (13) is arranged at the valve stem (4) or at an element (b 7,8) connected to the latter, the cage element (13) extending in direction to the piston element (3) and ends in radially inwardly directed restraining zones (15,19,23) which encompass the outer surface of the guide shoe (9) or projection (12) of this outer surface so that the guide shoe (9) is freely displaceable in the transverse direction relative to the valve stem (4) but is stil securely mounted thereto.

9 Claims, 5 Drawing Figures

HYDRAULIC VALVE CLEARANCE COMPENSATION APPARATUS FOR INTERNAL COMBUSTION ENGINES

STATE OF THE ART

Figure 1:
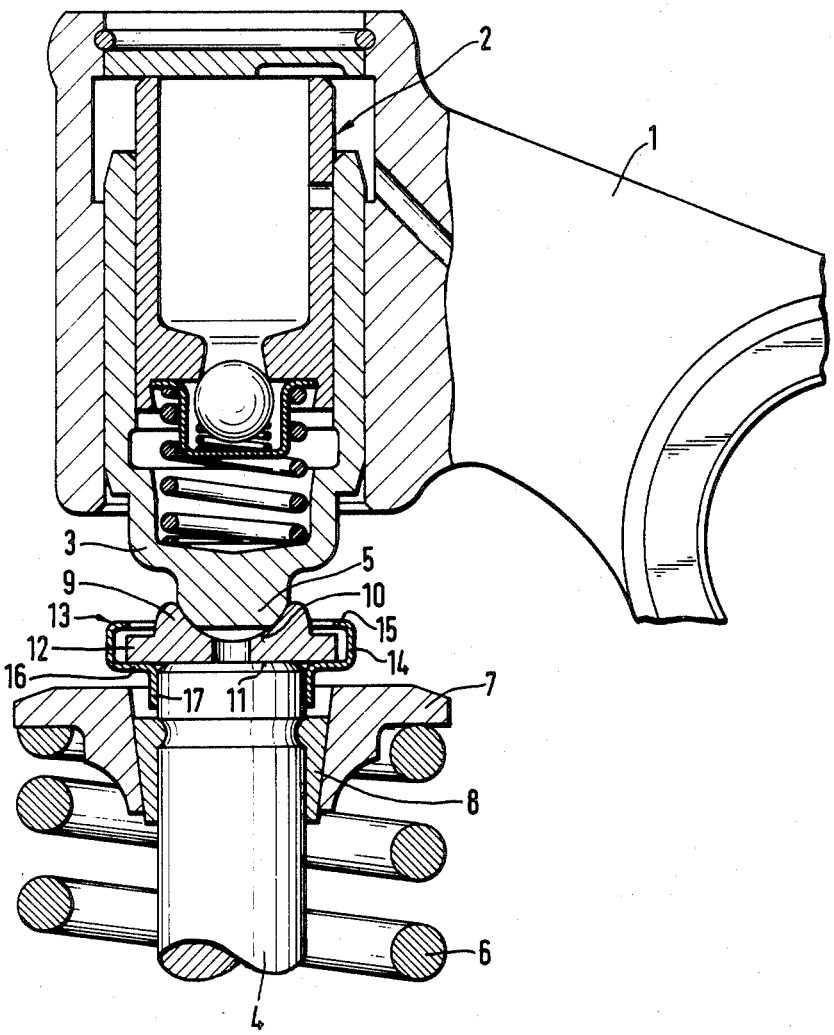

Hydraulic valve clearance compensation apparatus for internal combustion engines comprising a hydraulic compensation element accommodated in a bore of a rocker arm or like actuating element which bore extends in prolongation of the stem of a motor valve, and having a piston element guided for longitudinal displacement and provided with a crowned projection at its end facing the valve stem wherein between the crowned projection and the flat end face of the valve stem a guide shoe is arranged which, on the one hand, includes a spherical indentation engaged by the crowned projection of the piston element and, on the other hand, has a flat surface supported by the end face of the valve stem wherein the guide shoe is securely mounted to the valve stem are known.

The arrangement of such guide shoes is known and they are used to provide contact surfaces between the piston element and the valve stem for reducing wear and improving lubrication. In a known prior art such guide shoe is simply interposed between the crowned projection of the piston element and the end face of the valve stem and is stationarily retained during operation by the interlocking of the crowned projection and the spherical indentation. However, when dismantling the rocker arm, there is the danger that the guide shoe can drop into the engine block from which it can be removed only under very difficult conditions (DE-OS No. 31 18 466).

According to a further prior art, such a guide shoe is securely retained by providing it with a flanged border engaging in a circumferential groove of the valve stem. Although during dismantling of the rocker arm, the guide shoe is securely attached to the valve stem end and thus cannot be lost, there is the drawback that the producer of engines must stock different valves when manufacturing valve control systems with mechanical valve clearance compensation in addition to valve control systems with hydraulic clearance compensation apparatus.

OBJECTS OF THE INVENTION

It is an object of the invention to create a secure fixation of the guide shoe to the valve stem without requiring to stock different valves and without requiring modifications of the valve stem.

This and other objects and advantages of the invention will become obvious from the following detailed description.

THE INVENTION

The hydraulic valve clearance compensation apparatus of the invention for internal combustion engines comprising a hydraulic compensation element accommodated in a bore of a rocker arm or actuating element which bore extends in prolongation of the stem of a motor valve and having a piston element guided for longitudinal displacement and provided with a crowned projection at its end facing the valve stem wherein a guide shoe is arranged between the crowned projection and the flat end face of the valve stem which, on the one hand, includes a spherical indentation engaged by the crowned projection of the piston element and, on the other hand, has a flat surface supported by the end face of the valve stem wherein the guide shoe is securely mounted to the valve stem, is characterized in that a cage element (13) is arranged at the valve stem (4) or at an element (7,8) connected to the latter, the cage element (13) extending in direction to the piston element (3) and ends in radially inwardly directed restraining zones (15,19,23) which encompass the outer surface of the guide shoe (9) or projections (12) of this outer surface so that the guide shoe (9) is freely displaceable in the transverse direction relative to the valve stem (4) but is still securely mounted thereto. The cage element may be fixed to the valve stem or to an element connected to the latter without requiring any modifications of the valve stem.

Referring now to the drawings:

FIG. 1 is a longitudinal cross-section of a portion of a rocker arm and the end of a valve stem facing the rocker arm and FIGS. 2 to 5 are each a longitudinal cross-section of other embodiments for attaching a guide shoe to the valve stem end.

In the embodiment illustrated in FIG. 1, a hydraulic clearance compensation element (2) is supported in a known manner within the rocker arm (1) and includes an adjusting piston element (3) whose end facing the valve stem (4) ends in a crowned projection (5). The valve stem (4) is surrounded by the valve spring (6) which is supported by the spring plate (7) secured to the valve stem (4) by means of the valve keys (8). Arranged between the crowned projection (5) and the flat end face of the valve stem (4) is the guide shoe (9) which is provided with a spherical indentation (10) engaged by the crowned projection (5) of the piston element (3) and includes a flat end face (11) which cooperates with the end face of the valve stem (4).

The outer surface of the guide shoe (9) includes a radial projection (12). A cage element (13) is positioned at the end of the valve stem (4) and consists of a cylindrical collar (14) which extends in the direction of the piston element (3) and ends in radially directed restraining zones (15) behind the projection (12) to encompass the projection (12) that the guide shoe (9) can freely move transversely to the valve stem (9) but is still securely fixed thereto. The attachment to the valve stem (4) is obtained by providing the cylindrical collar (14) of the cage element (13) with a radial flange (16) connected to a hollow cylindrical element (17) which is pressed in force-locking manner onto the end of the valve stem (4).

Figure 2:
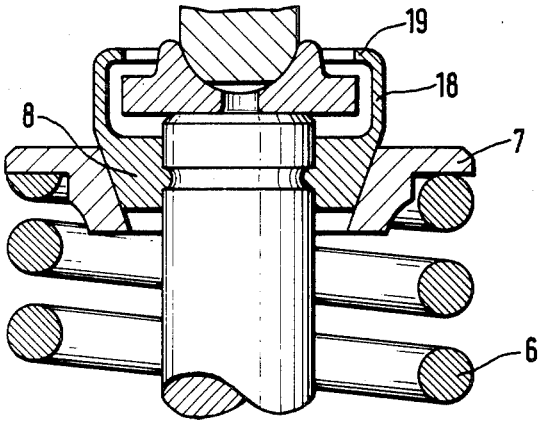
Figure 3:
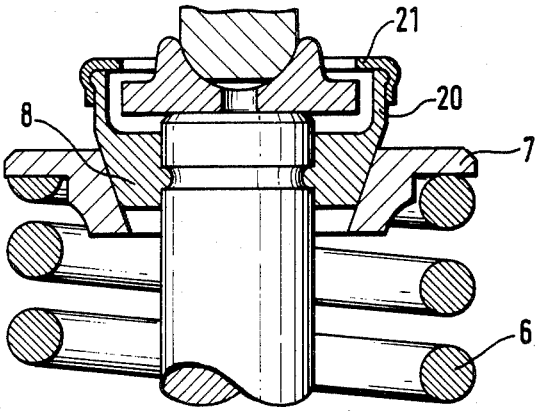
Figure 4:
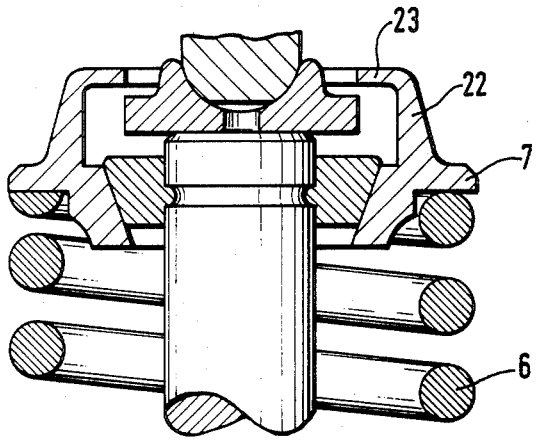
Figure 5:
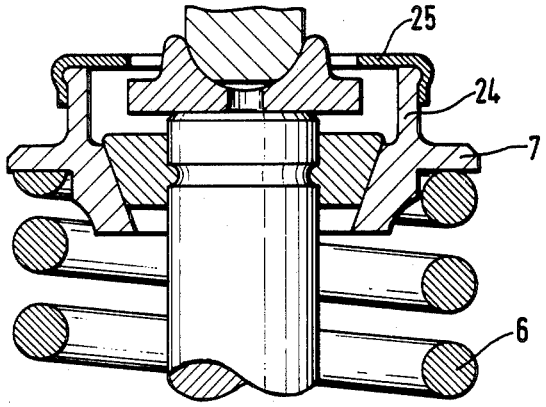

The following Figures illustrate embodiments in which the cage element is not secured to the valve stem but rather is connected to elements linked to the valve stem. FIG. 2 shows an embodiment in which the cylindrical collar (18) and the radial restraining zones (19) connected therewith are directly attached to the valve key (8). In contrast thereto, the embodiment of FIG. 3 illustrates the attachment of only a cylindrical collar (20) to the valve key (8) on which a sheet metal flange (21) is placed in form-fitting manner to define the radial restraining zone. In the embodiment of FIG. 4, a cylindrical collar (22) is provided with radial restraining zones (23) and is directly attached to the valve disk (7). FIG. 5 shows again a modification in which only a cylindrical collar (24) is attached to the valve disk (7) and placed on the cylindrical collar (24) in form-fitting manner is a sheet metal flange (25) which defines the restraining zones.

It is not necesary to design the restraining zones constantly as radial annular flanges as illustrated in the Figs. and, it is sufficient to design these restraining flanges as individual restraining zones extending over a portion of their circumference.

Various modifications of the apparatus of the invention may be made without departing from the spirit or scope thereof and it should be understood that the invention is intended to be limited only as defined in the appended claims.

What I claim is:

1. A hydraulic valve clearance compensation apparatus for internal combustion engines comprising a hydraulic compensation element accommodated in a bore of a rocker arm or actuating element which bore extends in prolongation of the stem of a motor valve and having a piston element guided for longitudinal displacement and provided with a crowned projection at its end facing the valve stem wherein a guide shoe is arranged between the crowned projection and the flat end face of the valve stem which, on the one hand, includes a spherical indentation engaged by the crowned projection of the piston element and, on the other hand, has a flat surface supported by the end face of the valve stem wherein the guide shoe is securely mounted to the valve stem, characterized in that a cage element (13) is arranged at the valve stem (4) or at an element (7,8) connected to the latter, the cage element (13) extending in direction to the piston element (3) and ends in radially inwardly directed restraining zones (15,19,23) which encompass the outer surface of the guide shoe (9) or projections (12) of this outer surface so that the guide shoe (9) is freely displaceable in the transverse direction relative to the valve stem (4) but is still securely mounted thereto.

2. A valve clearance compensation apparatus of claim 1, characterized in that the cage element (13) includes a cylindrical collar (14,18,20,22,24) whose inner diameter is greater than the greatest outer diameter of the guide shoe (9) and has radially inwardly directed restraining zones (15,19,23) provided at its end facing the piston element (3) and encompassing the greatest outer diameter of the guide shoe (9) with axial clearance.

3. A valve clearance compensation apparatus of claim 2, characterized in that the cylindrical collar (14) is provided at its end facing the valve stem (4) with a radial flange (16) which is connected to a hollow cylindrical element (17) placed on the valve stem end (4) in a force-locking or form-fitting manner.

4. A valve clearance compensation apparatus of claim 2, characterized in that the cylindrical collar (22,24) is part of a spring plate (7) fixed in a form-fitting manner to the valve stem (4) by means of valve keys (8).

5. A valve clearance compensation apparatus of claim 2, characterized in that the cylindrical collar (18,20) consists of individual segments which are part of the valve keys (8).

6. A valve clearance compensation apparatus of claim 4 characterized in that the cylindrical collar (14,28,22) is provided with restraining zones (15,19,23) integrally connected thereto.

7. A valve clearance compensation apparatus of claim 5 characterized in that the cylindrical collar (14,28,22) is provided with restraining zones (15,19,23) integrally connected thereto.

8. A Valve clearance compensation apparatus of claim 4 characterized in that the restraining zones are defined by a sheet metal flange (21,25) which is fixed to the cylindrical collar (20,24) in a force-locking or form-fitting manner.

9. A valve clearance compensation apparatus of claim 5 characterized in that the restraining zones are defined by a sheet metal flange (21,25) which is fixed to the cylindrical collar (20,24) in a force-locking or form-fitting manner.

* * * * *